US007073345B2

(12) United States Patent
Kentner et al.

(10) Patent No.: US 7,073,345 B2
(45) Date of Patent: Jul. 11, 2006

(54) REFRIGERATOR HAVING A HEATABLE INTERIOR SPACE

(75) Inventors: Wolfgang Kentner, Röfingen (DE); Harald Krauss, Aalen (DE); Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 42 days.

(21) Appl. No.: 10/989,810

(22) Filed: Nov. 16, 2004

(65) Prior Publication Data

US 2005/0109058 A1 May 26, 2005

Related U.S. Application Data

(63) Continuation of application No. PCT/EP03/05005, filed on May 13, 2003.

(30) Foreign Application Priority Data

May 16, 2002 (DE) ..... 102 21 898

(51) Int. Cl.
*F25D 21/06* (2006.01)

(52) U.S. Cl. ..... 62/276; 312/406

(58) Field of Classification Search ..... 62/264, 62/276, 414, 440, 447, 156; 312/406; 362/92; 337/327, 398, 380
See application file for complete search history.

(56) References Cited

U.S. PATENT DOCUMENTS

| | | | | | |
|---|---|---|---|---|---|
| 4,936,106 | A | * | 6/1990 | Beach et al. | 62/131 |
| 5,163,356 | A | * | 11/1992 | Chigira | 99/282 |
| 5,177,976 | A | * | 1/1993 | Lim et al. | 62/131 |
| 5,248,196 | A | * | 9/1993 | Lynn et al. | 312/406 |
| 5,326,578 | A | * | 7/1994 | Yun | 426/231 |
| 5,388,418 | A | * | 2/1995 | Martin et al. | 62/131 |
| 5,488,347 | A | * | 1/1996 | Gurski | 337/380 |
| 6,101,819 | A | | 8/2000 | Onaka et al. | |
| 6,907,663 | B1 | * | 6/2005 | Yoon et al. | 29/890.035 |

FOREIGN PATENT DOCUMENTS

| | | | | |
|---|---|---|---|---|
| EP | 0 484 860 | A1 | | 5/1992 |
| JP | 404218332 | A | * | 8/1992 |
| JP | 04257684 | A | | 9/1992 |
| JP | 407270032 | A | * | 10/1995 |
| JP | 410002657 | A | * | 1/1998 |
| WO | 98/05911 | | | 2/1998 |
| WO | 00/14465 | | | 3/2000 |

* cited by examiner

*Primary Examiner*—Mohammad M. Ali
(74) *Attorney, Agent, or Firm*—John T. Winburn; Russell W. Warnock; Craig J. Loest

(57) ABSTRACT

A refrigeration device has an interior that is surrounded by a thermally insulating housing and provided with a heating device for heating the interior. The housing contains an inner chamber and a thermal insulation layer that surrounds the chamber. The inner chamber contains an opening and the heating device is mounted on a support that can be accessed from the inner chamber and at least partially covers the opening.

13 Claims, 5 Drawing Sheets

REFRIGERATOR HAVING A HEATABLE INTERIOR SPACE

CROSS-REFERENCE TO RELATED APPLICATION

This is a continuing application, under 35 U.S.C. § 120, of copending international application No. PCT/EP03/05005, filed May 13, 2003, which designated the United States; this application also claims the priority, under 35 U.S.C. § 119, of German patent application No. 102 21 898.6, filed May 16, 2002; the prior applications are herewith incorporated by reference in their entirety.

BACKGROUND OF THE INVENTION

Field of the Invention

The present invention relates to a refrigerator having a heatable interior space.

At low ambient temperatures, the interior space of refrigerators, in which a single refrigerant circuit is used to cool both a normal refrigerating compartment and a deep-freeze compartment, has to be heated up. This is because it is not possible to independently regulate the cooling power output to the normal refrigerating compartment and the freezer compartment in appliances of this type. If the ambient temperatures are low, the normal refrigerating compartment requires low cooling power, such that thermostatic regulation performed by a temperature sensor disposed in the normal refrigerating compartment results in the entire refrigeration circuit being driven at low power. However, since the cooling-power requirement of the freezer compartment does not decrease in proportion to that of the normal refrigerating compartment with decreasing ambient temperatures, this leads to insufficient cooling of the freezer compartment if no corrective measures are taken.

One known remedial measure is to artificially heat the normal refrigerating compartment in such a situation. This leads to prolonged running times of the refrigerant circuit and thus to sufficient cooling of the freezer compartment as well.

Refrigerators without a light in the interior space have to be heated with the aid of a heating device specifically provided for this purpose. In the case of a refrigerator whose housing contains an inner container and an insulating layer made of expandable material surrounding the inner container, it is known to adhesively bond a foil heater to the inner container. However, this solution has several disadvantages.

One important disadvantage is that a foil heater adhesively bonded to the side of the inner container facing the insulating layer cannot be repaired in the event of damage, because the insulating layer would have to be destroyed in order to uncover the foil heater.

A second disadvantage is that fixing by use of adhesive bonding always entails residual uncertainties. If, specifically, the entire surface of the foil heater does not adhere to the inner container, this may cause non-uniform heating since the generated heat is dissipated more effectively by the regions of the foil heater which adhere properly to the inner container than by those regions which do not adhere. The latter may overheat and, as a result, damage the foil heater itself or the surrounding insulating layer or, respectively, the inner container. This problem is additionally exacerbated by the possibility of material of the insulating layer penetrating between the inner container and the foil heater when the foil heater does not adhere completely to the inner container. This leads to undesired insulation of the non-adhering regions of the foil heater with respect to the inner container in every case. In the worst-case scenario, if the material which has penetrated between the foil heater and the inner container expands still further, the foil heater can be torn away from the inner container at regions which originally adhered correctly, or can even be damaged.

SUMMARY OF THE INVENTION

It is accordingly an object of the invention to provide a refrigerator having a heatable interior space that overcomes the above-mentioned disadvantages of the prior art devices of this general type.

The object of the present invention is therefore to specify a refrigerator having an interior space that is enclosed by a thermally insulating housing, and a heating device for heating up the interior space. The housing contains an inner container and an insulating layer made of expandable material surrounding the inner container, in which the risk of the operability of the heater being impaired by the material of the insulating layer is eliminated or, in the event of disruption to the heater, it is possible to repair the latter.

The object is achieved by an opening being made in the inner container of the refrigerator according to the invention, and by the heating device being disposed in the opening on a surface, facing the interior space, of a support which blocks the opening. The heating device is accessible from the interior space of the refrigerator through the opening and can thus be repaired if necessary. The support that blocks the opening prevents the insulating material penetrating into the interior space upon expansion during the manufacture of the refrigerator.

The support is preferably disposed on the side of the inner container facing the foam layer. It is thereby possible, during assembly of the refrigerator, to first put the heating device into place from the outside of the inner container, this enabling easier connection of supply lines to the heating device than in the case where the heating device is mounted from the inside. After the heating device has been put into place, the opening can be covered by the support without any problem.

One further advantage of fitting the support to the outside of the inner container is that the support is pressed against the inner container by the insulating material as the latter expands, this promotes the leakproofness of the contact between the support and inner container against the passage of the insulating material.

The contact between the support and the inner container is preferably formed by a circumferential edge strip of the support.

A supply line to the heating device can be routed through between the support and the inner container in a simple manner. For this purpose, an open duct is preferably formed on the support and accommodates a section of the supply line with a form fit.

The support expediently has a circumferential frame that engages in the opening of the inner container with a form fit. The frame facilitates, on the one hand, putting the support into place on the inner container, and, on the other hand, it contributes to the leakproofness of the connection between the inner container and the support against the passage of the insulating material.

In order to hold the support in place in the opening, it is preferably provided with latching lugs engaging on the edge of the opening. If the above-mentioned circumferential frame is present, the latching lugs are expediently fitted thereto. In order to facilitate fitting of the support in the opening, the frame can be of flexible configuration, at least in parts in the region of the latching lugs.

The heating device is particularly preferably disposed between the support and a cover releasably fixed to the support. The cover protects the heating device from mechanical damage and/or from moisture penetrating from the interior space. The cover can be removed if the heating device needs to be repaired.

Furthermore, the heating device is preferably spaced apart from the support by projections disposed on the inside of the cover. Air circulating between the projections over a large part of the surface of the heating device permits temperature compensation between different regions of the heating device and thus prevents local overheating.

The projections can also be used to clamp in the heating device between themselves and the support. This renders superfluous complex measures for fixing the heating device to the support, which would have to be removed in the event of repair.

In order to promote heat exchange by air circulation, it is expedient if the projections are configured as vertically oriented ribs.

Other features which are considered as characteristic for the invention are set forth in the appended claims.

Although the invention is illustrated and described herein as embodied in a refrigerator having a heatable interior space, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
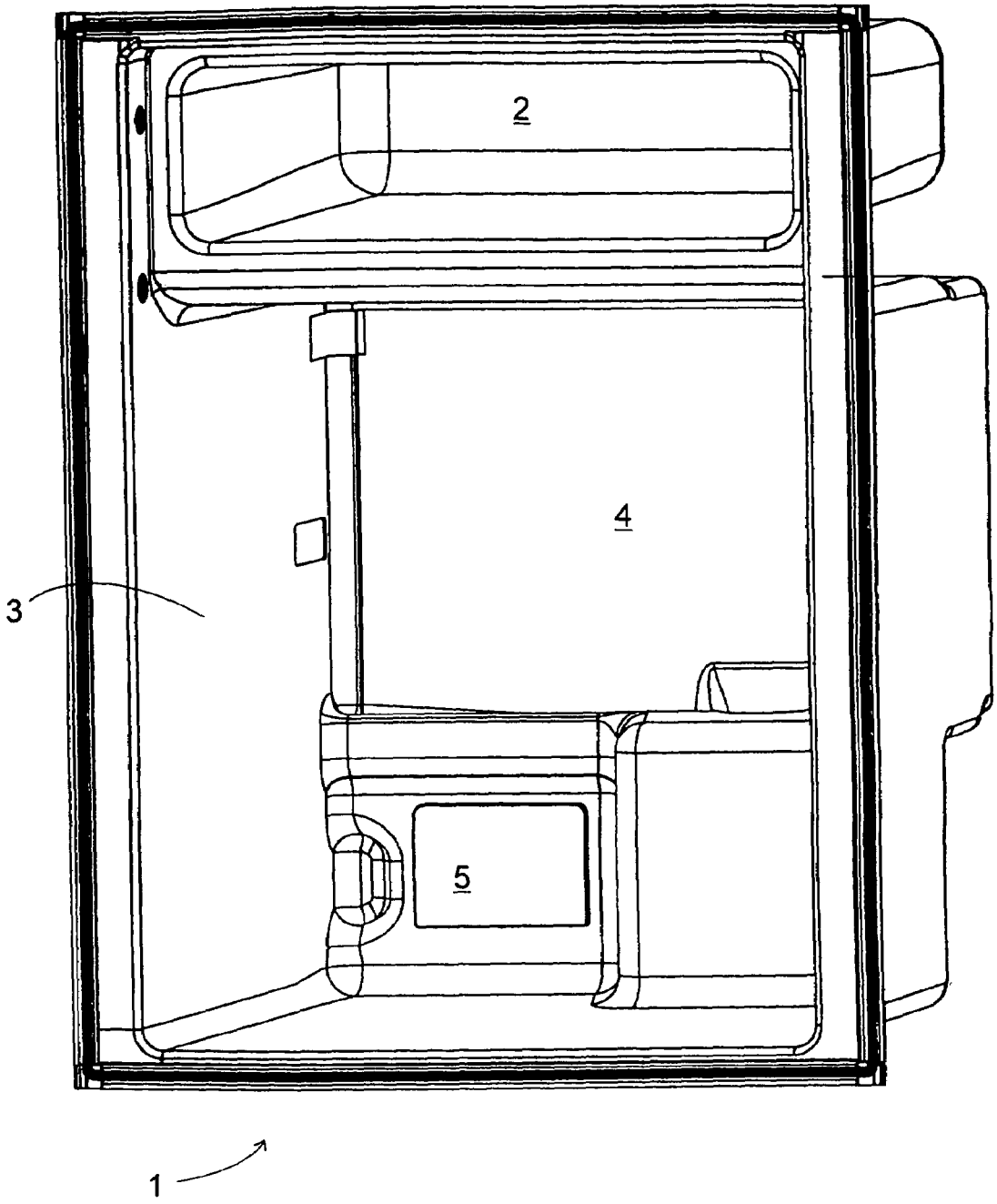
FIG. 1 is a diagrammatic, perspective, front view of an inner container of a refrigerator according to the invention.

Referring now to the figures of the drawing in detail and first, particularly, to FIG. 1 thereof, there is shown a perspective view of an inner container 1 of a refrigerator according to the invention. The inner container 1 is a unipartite hollow body that is formed by deep-drawing from flat plastic material. It is subdivided into a freezer compartment 2 and a normal refrigerating compartment 3 which are provided in order to be cooled in the finished refrigerator by a common evaporator or two evaporators series-connected in a refrigeration circuit. A planar face 4 on the rear side of the normal refrigerating compartment 3 is provided in order to fit the evaporator to its outer side. In the lower region of the normal refrigerating compartment 3, an opening is punched into the rear wall of the inner container 1, into which opening a heating subassembly, of which only a cover 5 facing the interior space can be seen in FIG. 1, is mounted.

Figure 2:
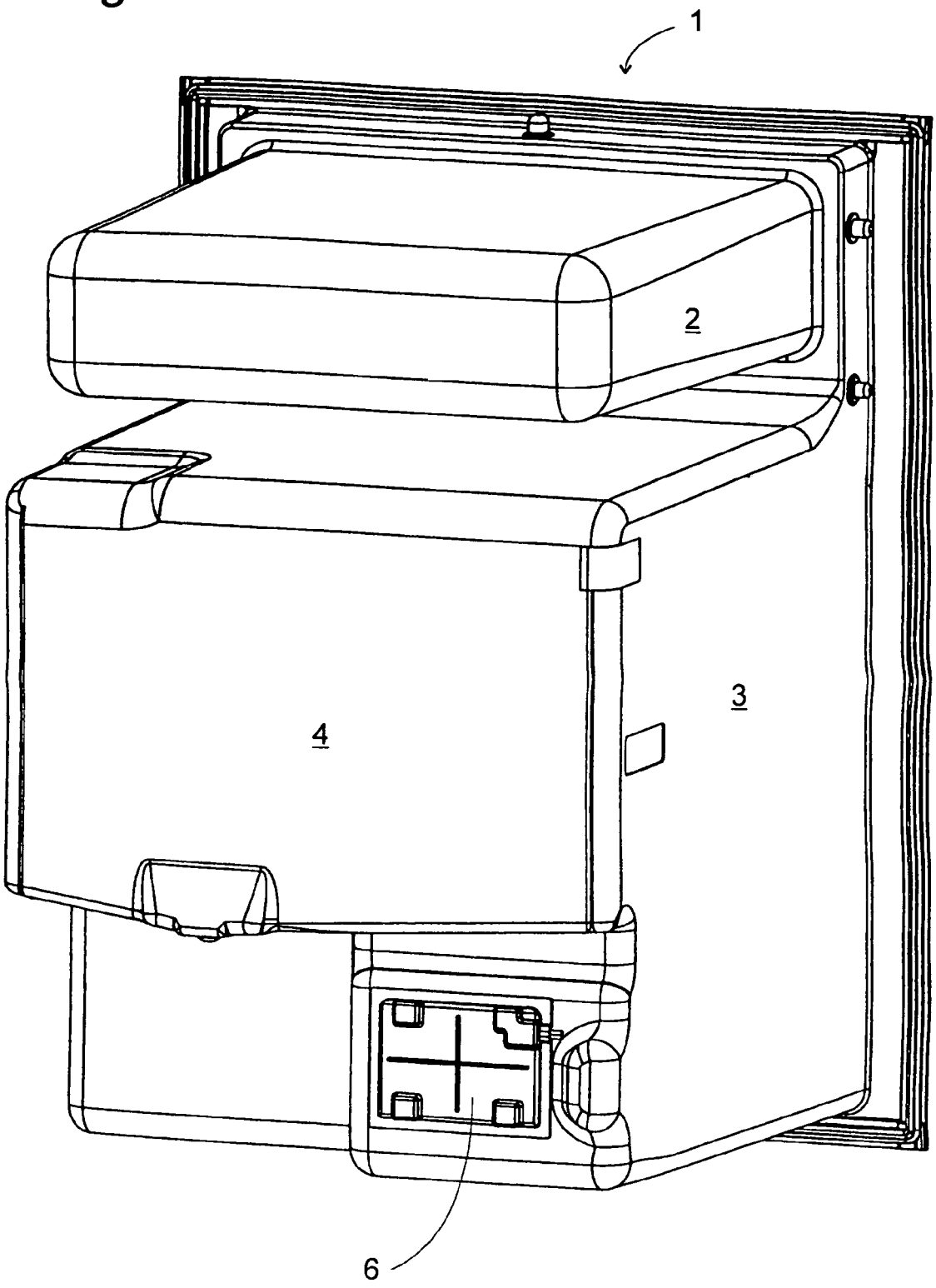
FIG. 2 is a perspective, rear view of the inner container from FIG. 1.

In the rear view of the inner container 1 shown in FIG. 2, a support 6 of the heating subassembly can be seen.

Figure 3:
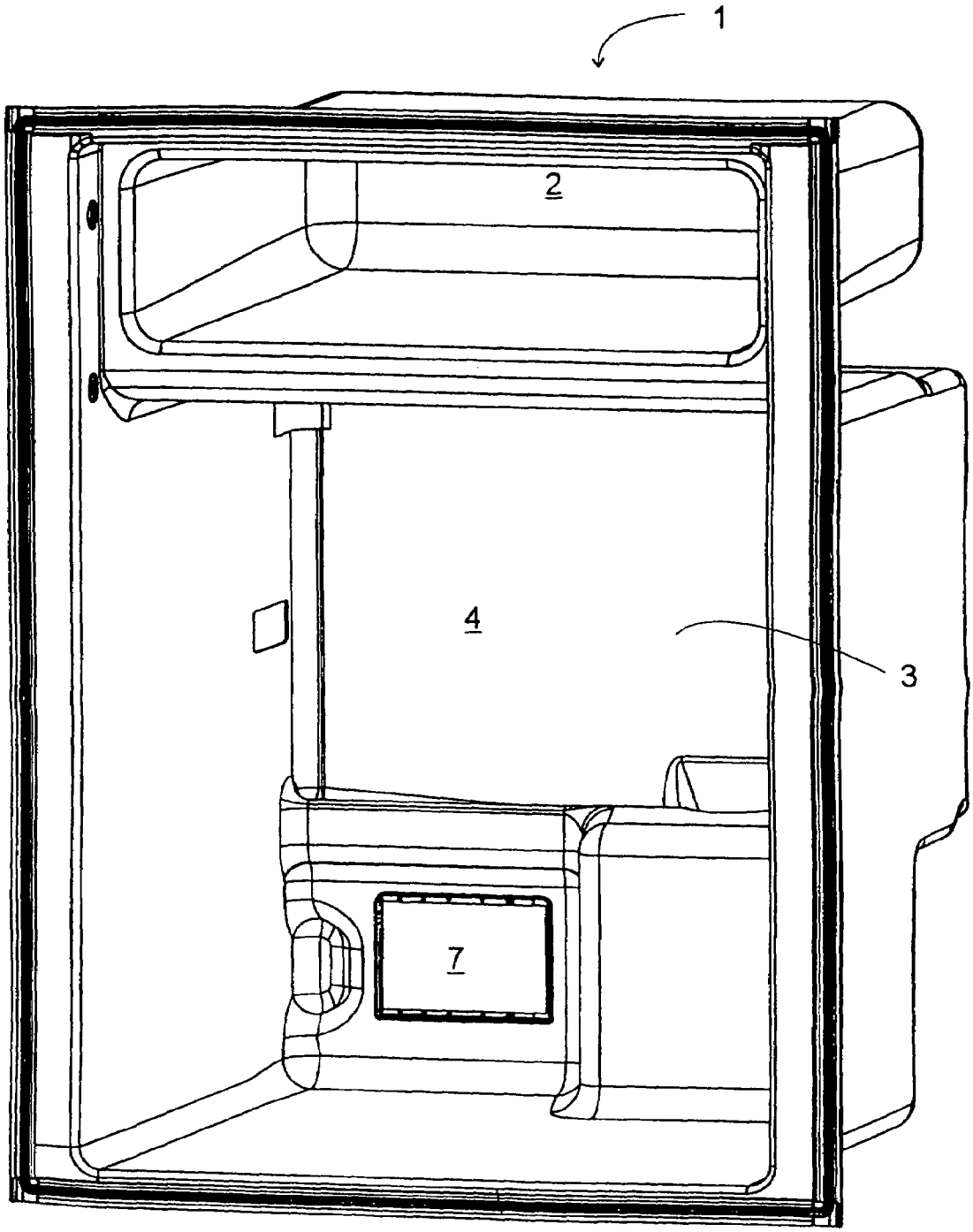
FIG. 3 is a perspective, front view analogous to FIG. 1, with a cover of a heating subassembly of the refrigerator removed.

As shown in FIG. 3, the cover 5 of the heating subassembly can be removed in the state mounted on the inner container 1 such that a foil heater 7 which is enclosed between the cover 5 and support 6 of the heating subassembly is accessible from the normal refrigerating compartment 3.

Figure 4:
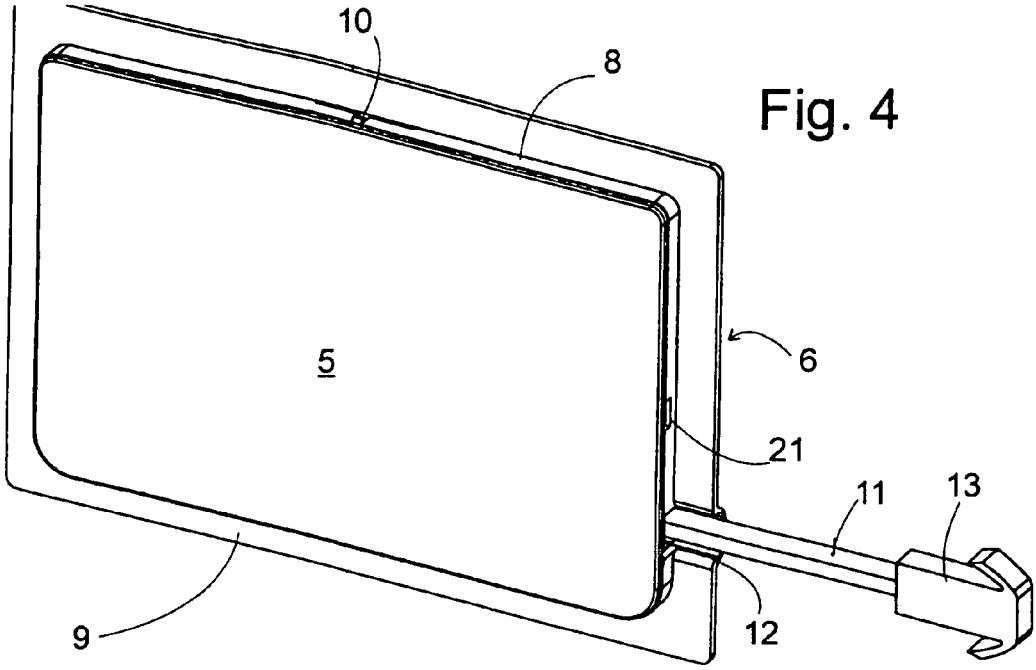
FIG. 4 is a perspective view of the heating subassembly.

FIG. 4 shows the heating subassembly separated from the inner container and in the assembled state. A circumferential frame 8 is integrally formed on the support 6 and in the mounted state engages in the punched opening of the inner container 1 with a form fit.

A circumferential edge strip 9 of the support 6 surrounds the frame 8 and is provided in order to bear in the mounted state against the outer side of the inner container 1.

Latching lugs 10 which can be elastically displaced into the interior of the frame are formed on the frame 8 at a distance from the edge strip 9 corresponding to the wall thickness of the inner container 1, and, in the mounted state of the heating subassembly, hold the edge strip 9 pressed against the outer side of the inner container 1. This and the form-fitting engagement of the frame 8 in the opening of the inner container 1 prevent expandable material, such as in particular polyurethane foam, from penetrating through the opening of the inner container 1 into the interior of the refrigerating compartment 3 when, after mounting of the heating subassembly, this material is injected into an intermediate space between the inner container 1 and a non-illustrated outer wall of the refrigerator.

A tool can be inserted into a niche 14 of the frame 8 in order to feed the cover 5 to, and remove the cover 5 from, the frame 8.

An electrical supply line 11 of the heating subassembly runs through a duct 12 recessed in the edge strip 9. The penetration of insulating material into the interior of the heating subassembly at the level of the duct 12 is also prevented by precisely matching the cross sections of supply line 11 and duct 12 to one another. The supply line 11 bears a plug-in connector 13 at its free end.

The heating subassembly can be mounted in simple manner by being pressed into the opening of the inner container 1 from the outside and being latched therein, and by the plug-in connector being inserted into a non-illustrated complementary bushing which is disposed outside the inner container 1.

Figure 5:
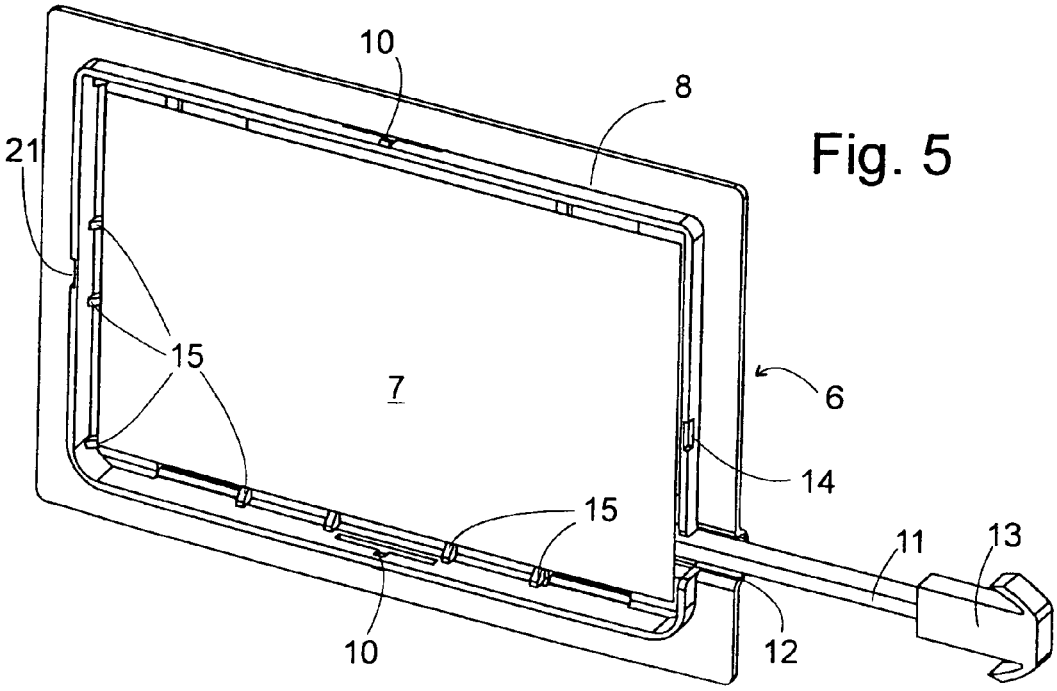
FIG. 5 is a perspective view of the heating subassembly without the cover.

FIG. 5 shows, in the same perspective as FIG. 4, the heating subassembly with the cover 5 removed. The electrical heating foil 7 connected to the supply line 11 occupies almost the entire face of the support 6 surrounded by the frame 8. It bears loosely against the support 6 or is at best adhesively bonded to it at points. The position of the heating foil 7 on the support 6 is defined by a plurality of short, triangular webs 15 which each extend inward from the frame 8 and keep the heating foil 7 spaced apart from the frame 8.

A short section of the frame 8 is interrupted at the level of the duct 12 such that, during mounting of the refrigerator, the heating foil together with the connected supply line 11 and plug-in connector 13 can be conveniently put into place.

Figure 6:
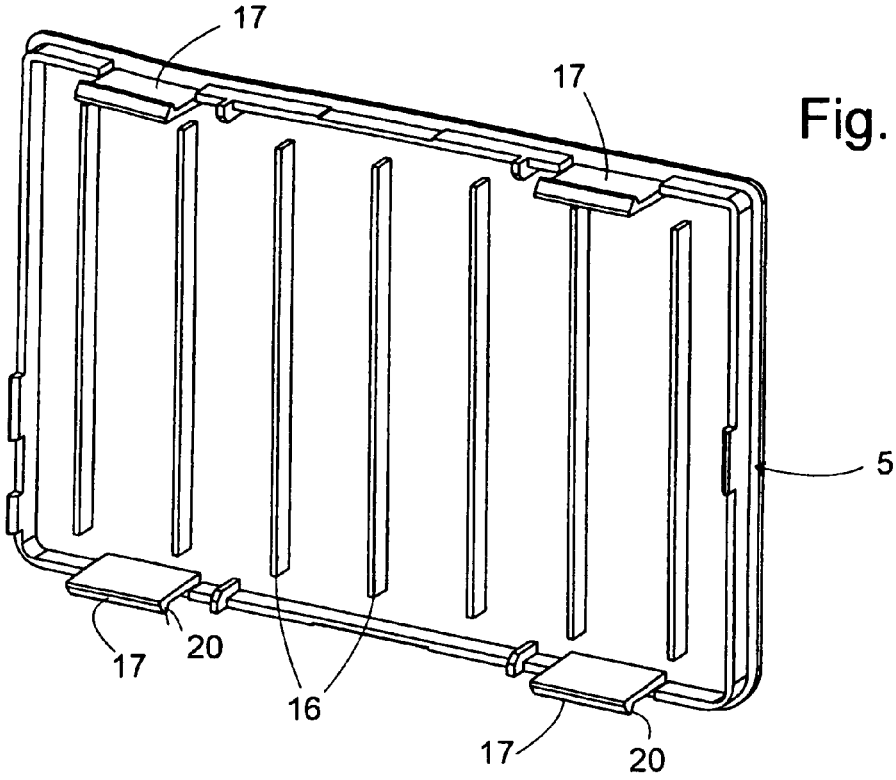
FIG. 6 is a perspective view of the cover.

FIG. 6 shows a perspective view of the cover 5 of the heating subassembly, as seen from the inside. A plurality of parallel ribs 16 are formed on the inside of the cover 5, each at a level which is dimensioned such that the heating foil 7 is held pressed against the support 6 when the cover is closed. The ribs 16 thus keep free between the heating foil 7 and the cover 5 an intermediate space in which air can circulate and thus effect thermal compensation between different regions of the heating foil. The circulation of this layer of air contributes, along with heat of radiation, to heating of the cover 5 and therefore of the normal refrigerating compartment 3 of the refrigerator.

Figure 7:
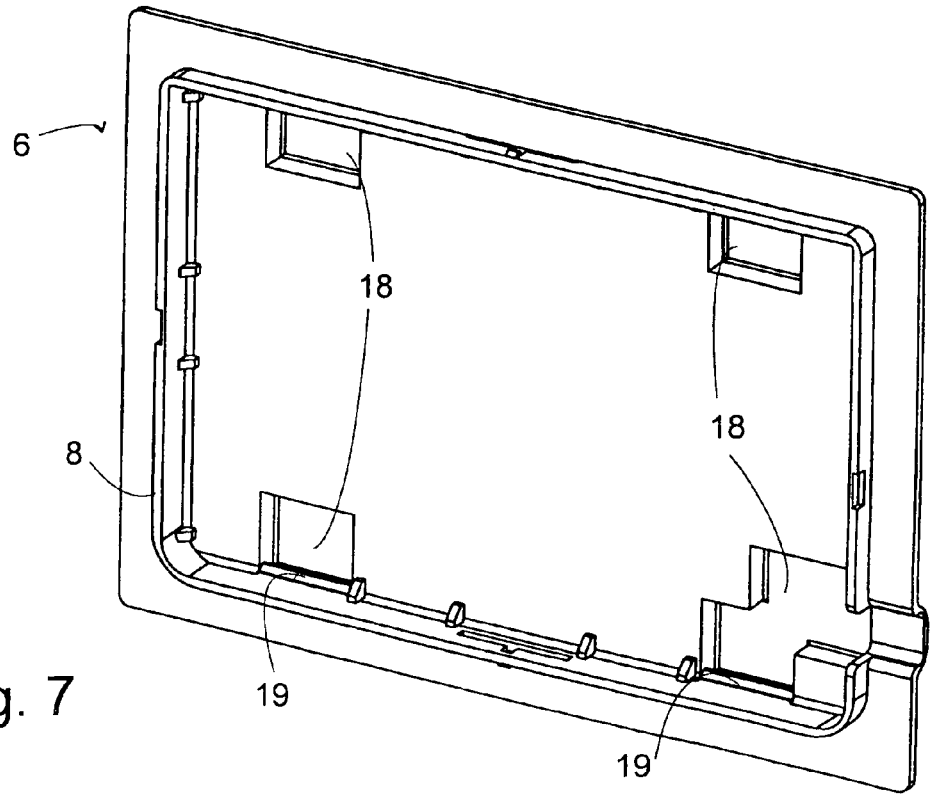
FIG. 7 is a perspective view of a support of the heating subassembly.

Four latching arms 17 are integrally formed in the vicinity of the edge of the cover 5. The length of these latching arms is greater than the height of the ribs 16. In the mounted state of the heating subassembly, the latching arms 17 engage through the intermediate space, which can be seen in FIG. 5, between the frame 8 and the heating foil 7 secured by the webs 15, into chambers 18 formed on the support 6. The chambers 18 can be seen in the view of the support 6 shown in FIG. 7. The latching arms 17 and latching lugs 19 protruding laterally into the chambers 18 each have latching faces 20 which run at an obtuse angle to the insertion direction of the latching arms 17 and thus permit the cover 5 to be released from the support 6 by simply pulling at the cover 5.

We claim:

1. A refrigerator, comprising:

a thermally insulating housing enclosing an interior space, said thermally insulating housing having an inner container and a thermal insulation layer surrounding said inner container, said inner container having an opening formed therein;

a support disposed in said inner container and being accessible from said interior space and at least partially covering said opening; and a heating device for heating up said interior space, said heating device disposed on said support.

2. The refrigerator according to claim 1, wherein said support is disposed on a side of said inner container facing said thermal insulation layer, and completely covering said opening.

3. The refrigerator according to claim 2, wherein said support has a circumferential edge strip which is in contact with said inner container and bears against edges of said opening in a sealing manner.

4. The refrigerator according to claim 1, further comprising and said support is provided with said heating device on a surface facing said interior space.

5. The refrigerator according to claim 4, further comprising a supply line connected to said heating device, said supply line is routed through between said support and said inner container.

6. The refrigerator according to claim 5, wherein said support has a duct formed therein and said supply line is accommodated in said duct with a form fit.

7. The refrigerator according to claim 1, wherein said support has a circumferential frame which engages in said opening with a form fit.

8. The refrigerator according to claim 1, wherein said support has latching lugs engaging on an edge of said opening.

9. The refrigerator according to claim 1, further comprising a cover releaseably fixed to said support, said heating device is disposed between said support and said cover.

10. The refrigerator according to claim 9, further comprising projections disposed on an inside of said cover, said heating device is spaced apart from said support by said projections.

11. The refrigerator according to claim 10, wherein said heating device is clamped in between said projections and said support.

12. The refrigerator according to claim 10, wherein said projections are vertically oriented ribs.

13. The refrigerator according to claim 1, wherein said heating device is an electric foil heater.

* * * * *